US009346653B1

(12) United States Patent
Jawidzik et al.

(10) Patent No.: US 9,346,653 B1
(45) Date of Patent: May 24, 2016

(54) CORD RETRACTOR

(71) Applicant: Mindray DS USA, Inc., Mahwah, NJ (US)

(72) Inventors: Geoffrey C. Jawidzik, Mahwah, NJ (US); James Patrick Thrower, Oakland, NJ (US); Peter B. Schon, New York, NY (US)

(73) Assignee: SHENZHEN MINDRAY BIO-MEDICAL ELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 14/549,355

(22) Filed: Nov. 20, 2014

(51) Int. Cl.
*B65H 75/00* (2006.01)
*B65H 75/48* (2006.01)

(52) U.S. Cl.
CPC ..... *B65H 75/486* (2013.01)

(58) Field of Classification Search
CPC .... B65H 75/40; B65H 75/446; B65H 75/486; B60L 11/1816
See application file for complete search history.

(56) References Cited

U.S. PATENT DOCUMENTS 1,159,124 A * 11/1915 Steen ..... H02G 11/02 191/12.2 R
3,128,857 A * 4/1964 Walton ..... B65H 75/4455 191/12.2 R
3,806,671 A * 4/1974 Anderson ..... H02G 11/02 191/12.2 R
5,117,456 A * 5/1992 Aurness ..... H04M 1/15 191/12.2 R
5,299,670 A * 4/1994 Willard ..... H04M 1/15 191/12.2 R
5,848,642 A * 12/1998 Sola ..... E21B 17/203 137/355.16
6,273,354 B1 * 8/2001 Kovacik ..... B65H 75/40 191/12.2 R
7,264,478 B1 * 9/2007 Downing ..... B65H 75/425 191/12.4
2014/0311849 A1 * 10/2014 Iwami ..... H02J 7/00 191/12.4
2014/0339039 A1 * 11/2014 Ono ..... B65H 75/40 191/12.4
2014/0339352 A1 * 11/2014 Iwami ..... B65H 75/40 242/405
2015/0008274 A1 * 1/2015 Mizuno ..... H02G 11/02 242/404
2015/0014128 A1 * 1/2015 Mizuno ..... H02G 11/02 200/51.09

* cited by examiner

*Primary Examiner* — Jason C Smith
(74) *Attorney, Agent, or Firm* — Kory D. Christensen; Stoel Rives LLP

(57) ABSTRACT

A cord retractor includes a support member, a first length of electrical cord, a spool, and a second length of electrical cord. The spool includes a helical groove on an outer surface of the spool. The helical groove has a width corresponding to a cross-sectional width of the first length of electrical cord, and the spool is rotatably mounted on the support member. The second length of electrical cord is electrically coupled to the first length of electrical cord. A first portion of the second length of electrical cord is secured at a rotating location, and a second portion of the second length of electrical cord is secured at a stationary location. The first length of electrical cord is selectively extendable from and retractable on the spool, and the second cord flexes to accommodate the movement of the rotating location with respect to the stationary location.

26 Claims, 8 Drawing Sheets

CORD RETRACTOR

TECHNICAL FIELD

The present disclosure relates to power cords and power cord storage, and more particularly relates to cable retractors for power cords.

DETAILED DESCRIPTION OF PREFERRED EMBODIMENTS

Figure 1:
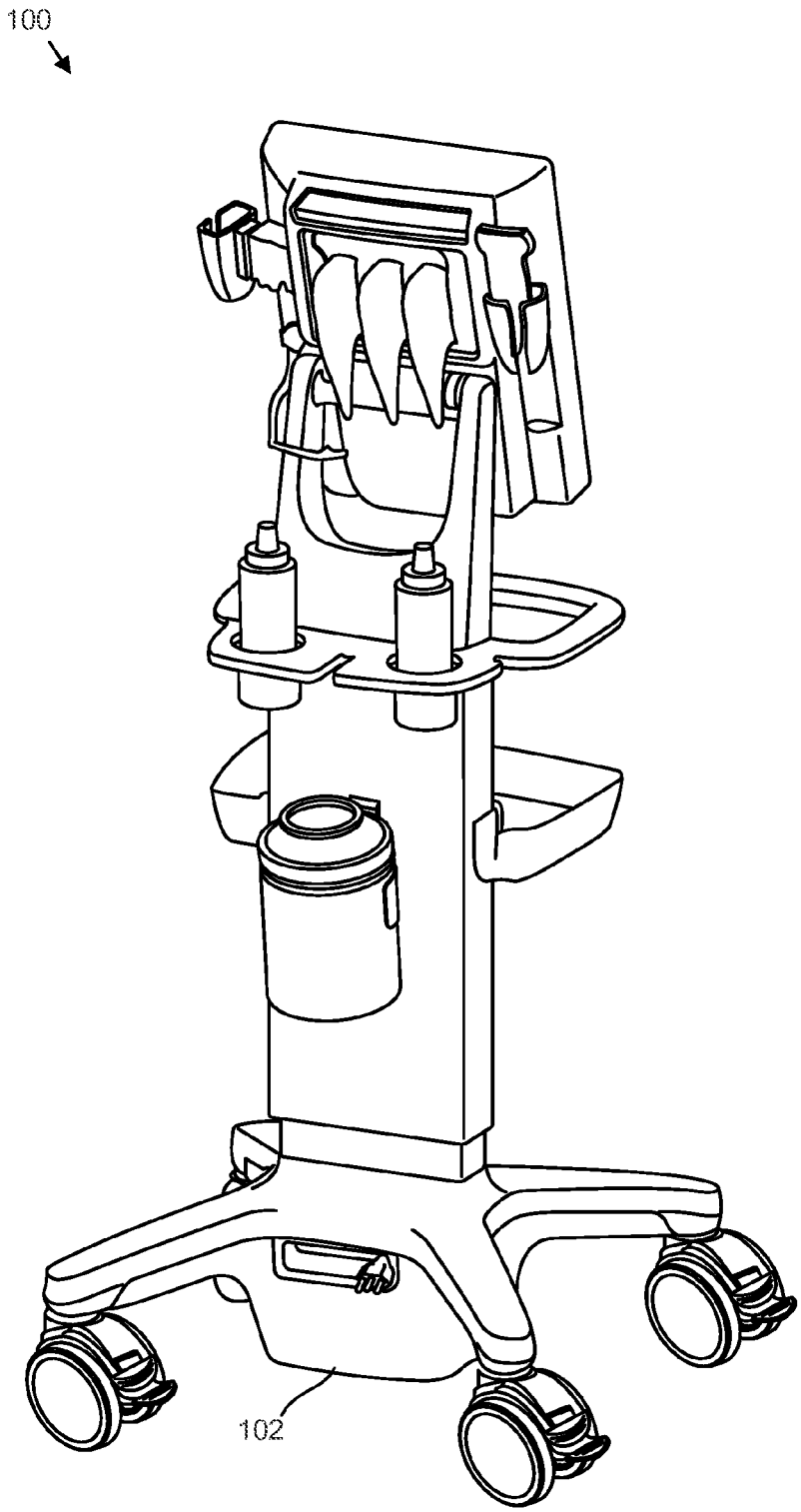
FIG. 1 is a perspective view of a medical device trolley having a cable retractor, according to one embodiment.

Power cords are often used to conduct electrical power from an outlet to provide power to electrically powered devices. When such a device is relatively stationary, the power cord may be left connected between the outlet and the device and may be positioned or routed so as to be acceptably non-intrusive of normal activities of a user. However, when such a device is relatively mobile, the power cord is necessarily disconnected during transport, and may be wound onto a suitable feature or features of the device, to facilitate storage during transport.

In cases where transport is very frequent, mechanisms may be provided to automatically wind the power cord onto a suitable feature or features of the device. Such mechanisms commonly employ a cylindrical spool, an intermittently engaging ratchet, and sliding electrical contacts. The cylindrical spool or spools may be used to wind a power cord. The ratchet may intermittently prevent the cord from retracting as it is deployed from the device (e.g., by manually pulling upon the cord). The sliding electrical contacts may create and maintain electrical connection between the electrical terminations of the power cord that are fixed on the rotating spool, and corresponding electrical terminals that are fixed on the device or a second spool. For example, the sliding electrical contacts may slide over the fixed electrical terminals to maintain electrical communication.

However, Applicants have recognized that existing cord and cable retracting mechanisms often have a number of problems. For example, it is often possible for ratchet mechanisms to be in a state that prevents retraction of the power cord when the power cord is pulled to its maximum extent. This may be due to the cord being extended at an unknown distance from the spool. Furthermore, it is possible for the power cord to become jammed as it is retracted onto the spool due to "bunching" of the cord on the spool. This bunching may happen due to lack of control of the position of the cord along the length of the spool. It is also possible for the sliding electrical contacts to lose electrical conductivity due to oxidation, accumulation of dirt, wear, etc. Reduced conductivity can result in generation of heat, or failure of the retracting mechanism to provide electrical power to a load.

The present disclosure presents a plurality of cable retractors and retraction mechanisms. The disclosed embodiments may provide improved operation with respect to one or more of the above problems, and/or provide other benefits. In one embodiment, a cable retractor includes a plug and jack capable of carrying the required power. The plug and jack may be used to make the electrical connection from the rotating cord to a stationary hub. For example, a cord may extend from the plug and jack to a stationary location and the cord may accommodate rotation of a spool by flexing or twisting. In one embodiment, the plug and jack each include three contacts to accommodate ground, power, and neutral wires. In one embodiment, a cable retractor may include a spool or hub that has a spiral channel extending around the spool or hub and into which the cable is automatically guided as it is wound onto the hub. For example, the channel may include grooves and ridges similar to a screw thread. The grooves and ridges may be sized to accommodate the power cord, or at least a portion of the power cord.

A detailed description of systems and methods consistent with embodiments of the present disclosure is provided below. While several embodiments are described, it should be understood that disclosure is not limited to any one embodiment, but instead encompasses numerous alternatives, modifications, and equivalents. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure.

Turning to the figures, FIG. 1 illustrates a medical device trolley 100 with one embodiment of a cable retractor 102. The trolley 100 may include a port or station for one or more electrical devices, such as a patient monitor. The trolley 100 may also include an electrical outlet for plugging in other devices. The cable retractor 102 may include a cable to selectively connect the trolley 100 to a wall outlet and power any connected devices, recharge a battery, or the like. In one embodiment, the cable retractor 102 allows a cord or cable to selectively extend for connection to a power outlet and retract for transportation. The cable retractor 102 may provide power to the trolley 100 and/or any electrical devices on or plugged into the trolley 100. The cable retractor 102 may be integrated with the trolley 100 or may be mounted on a mounting structure of the trolley 100. The trolley 100 is only one example of a device on which a cable retractor 102 is mounted. For example, the cable retractor 102 may be sized for or mounted on any type of device or structure that may selectively use electrical power.

Figure 2:
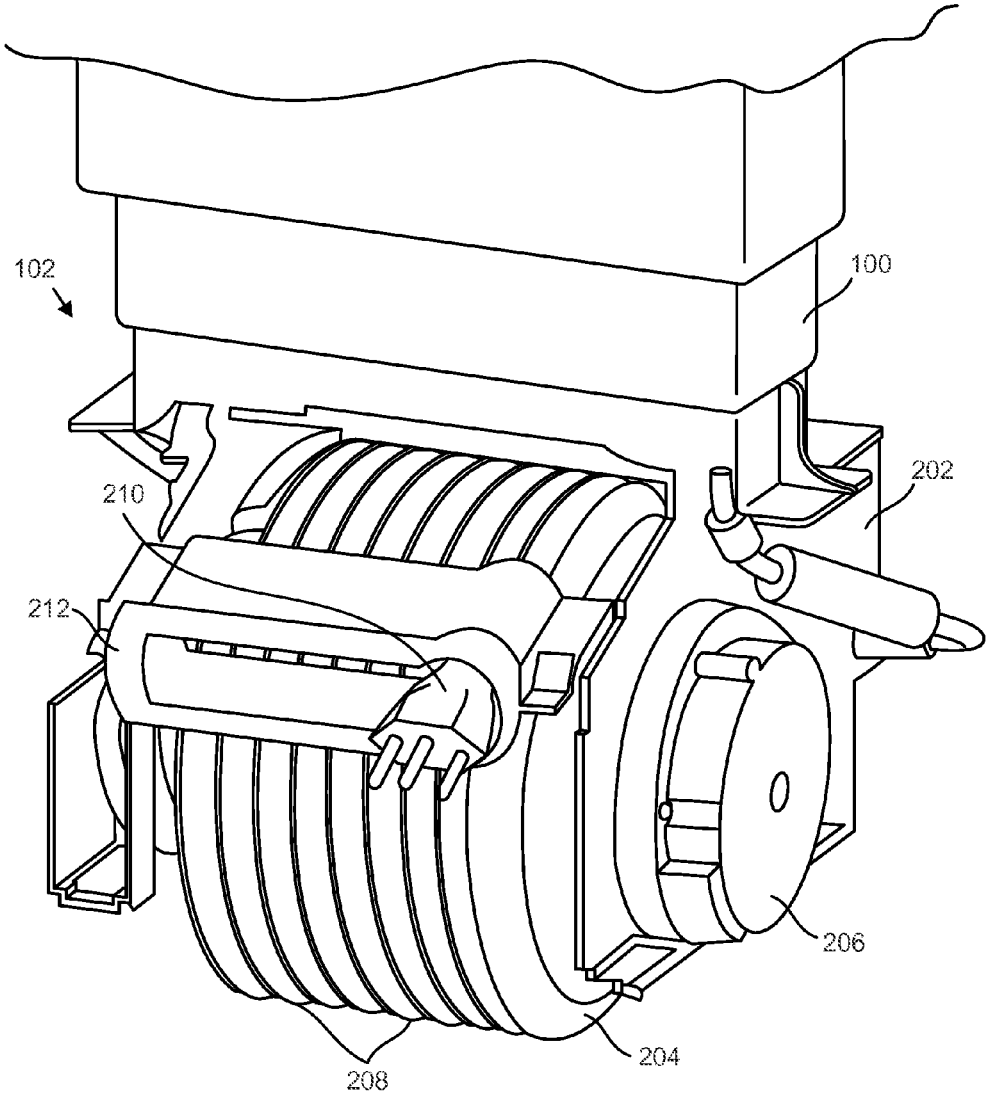
FIG. 2 is a perspective view of interior components of a cable retractor, according to one embodiment.

FIGS. 2-6 illustrate various views of one embodiment of a cable retractor 102. FIG. 2 is a close-up view of the cable retractor 102 with an exterior housing or casing removed. The cable retractor 102 includes a structural bracket 202 or other support member that provides mechanical support for the assembly and attaches the cable retractor 102 to the trolley 100. The bracket 202 provides a support structure for mounting and/or supporting other elements of the cable retractor 102. In one embodiment, the bracket 202 includes attachment mechanisms or features (e.g., holes or a corresponding shape) to secure the cable retractor 102 to the trolley 100 or other electrical device.

The cable retractor 102 includes a spool 204 rotatably mounted on the bracket 202. For example, the spool 204 may be mounted on an axle (see FIGS. 3-6), one or more bearings (see FIG. 4), or the like to allow the spool 204 to rotate with respect to the bracket 202 and/or one or more other components of the cable retractor 102. A power spring 206 provides a torsional force to the spool 204 in a rotational direction to bias the spool 204 toward a wound or retracted position. The power spring 206 is given by example only and may be replaced with any other type of spring or biasing member to rotationally bias the spool 204 toward a wound position or in a retracting rotational direction.

A retractable cable 208 is shown wound around the spool 204. The spool 204 includes a groove or channel around an outside surface to accommodate the retractable cable 208. In FIG. 2, the groove or channel (see, e.g., FIG. 4) is obscured by the retractable cable 208 which is wound around the spool 204 following the channel. The retractable cable 208 includes a flexible electrical cable that allows the retractable cable 208 to be selectively extended and retracted onto the spool 204. The retractable cable 208 includes a plug connector 210 at an end extending from the spool 204 that is configured to couple to an electrical outlet. For example, the retractable cable 208 may be extended to couple a plug 210 to a wall outlet to provide power to the trolley 100 or another attached device or system. Similarly, the retractable cable 208 may be retracted to a fully retracted position (as shown) for storage of the retractable cable 208 during transport.

The cable retractor 102 also includes a dispensing guide 212 that causes the retractable cable 208 to extend from the spool 204 at a specific location and/or angle. The dispensing guide 212, along with the groove or channel of the spool 204, causes an amount of retractable cable 208 extending from the spool 204 to be determined based on a rotational position of the spool 204. For example, given a specific rotational position of the spool 204, it may be precisely known or determined how much of the retractable cable 208 extends from the spool 204 or remains wound on the spool 204. The dispensing guide 212 includes a hole or grommet that has a fixed position in relation to the bracket 202 and thus predetermines an angle or angular location at which the retractable cable 208 extends from the spool 204.

Figure 3:
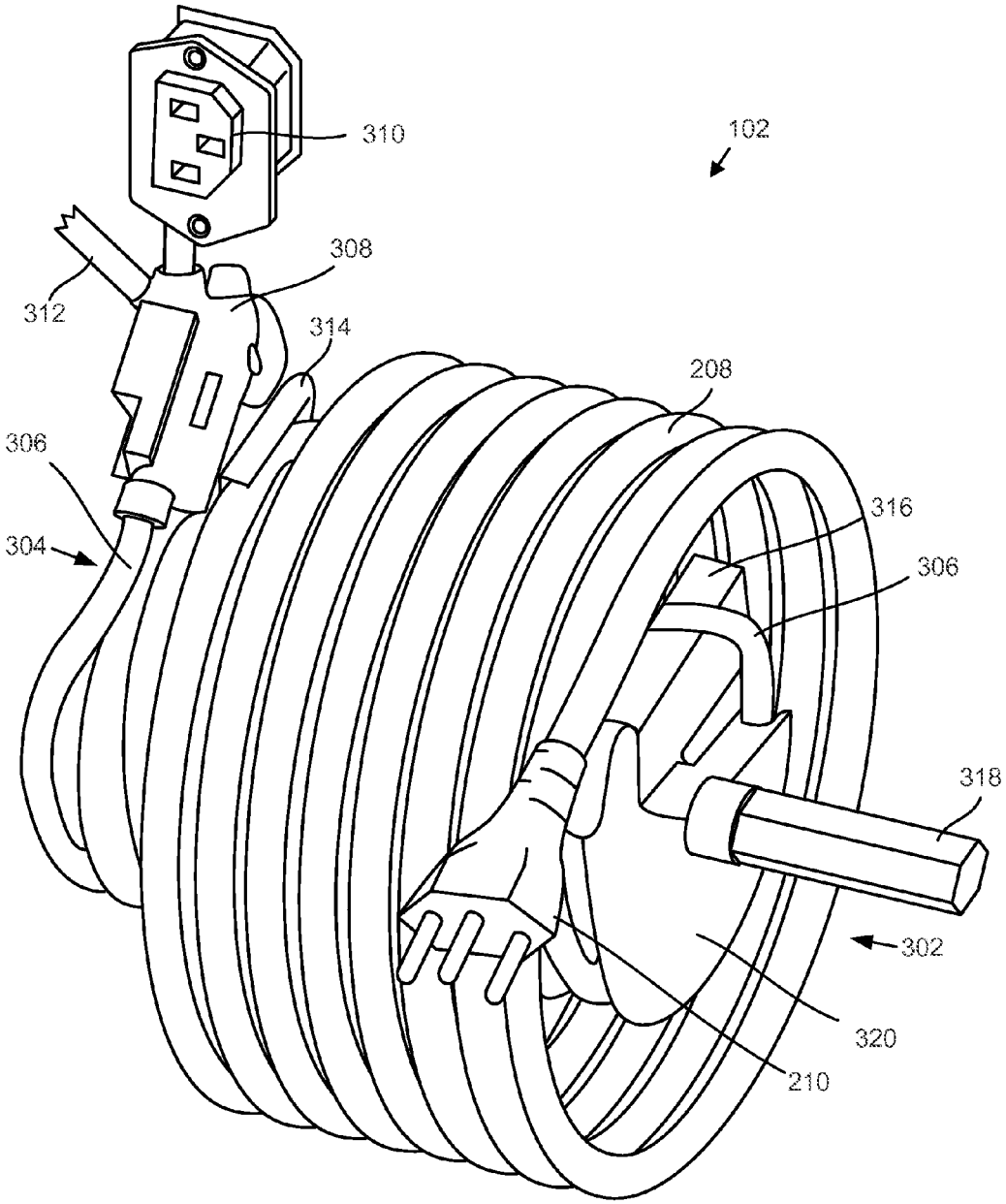
FIG. 3 is another perspective view of interior components of a cable retractor, according to one embodiment.

FIG. 3 shows the cable retractor 102 of FIG. 2 with the bracket 202, spool 204, power spring 206, and dispensing guide 212 removed to illustrate other components of the cable retractor 102. The retractable cable 208 is shown in a wound helical position as shown in FIG. 2. Near a first end 302 of the cable retractor 102, the retractable cable 208 is connected to a plug connector 210. Near a second end 304 of the cable retractor 102, the retractable cable 208 extends toward a region interior[GJ1] to the helix formed by the retractable cable 208 to connect with an interior cable 306. Electrical connectors (obscured by the retractable cable 208) are used to connect the retractable cable 208 with the interior cable 306. The interior cable 306 extends from the electrical connectors and is wound, interior to the helix formed by the retractable cable 208, from the first end 302 to the second end 304. Near the second end 304, the interior cable 306 connects to an electrical junction 308 where electrical power is provided to an outlet 310 and to an input 312 to the trolley 100, or other device.

The outlet 310 may be used to electrically connect to an electrical device such that the retractable cable 208 and the interior cable 306 provide electrical power to a device via the outlet 310. Thus, electrical connection from the retractable cable 208 to a device is achieved via the interior cable 306. According to one embodiment, one end or portion of the interior cable 306 is fixed relative to the spool 204 (and an external cable such as the retractable cable 208) while the another end or portion of the interior cable 306 is fixed relative to a bracket 202 (see FIG. 2). Thus, the different ends or portions of the interior cable 306 may move, rotate, and/or twist with respect to each other. In one embodiment, a first spool bracket 314 is used to attach the retractable cable 208 to the spool 204 and a second spool bracket 316 is used to attach a portion of the interior cable 306 to the spool 204 (not shown). A cable clamp, or other fastener, may be used to fasten another portion of the interior cable 306 to the bracket 202. The electrical junction 308 of the interior cable 306 may also be fastened to the bracket 202 using screws (not shown).

Also shown in FIG. 3 are an axle 318 and guide disks 320. Some of the guide disks 320 are obscured by the retractable cable 208. The spool 204 may be mounted on the axle 318. In one embodiment, the axle 318 may be mounted on bearings and the spool 204 may be mounted on the axle 318 to rotate with the spool 204. In one embodiment, the spool 204 may rotate independently of the axle 318. The guide disks 320 are mounted on the axle 318 and guide the interior cable 306 from the first end 302 to the second end 304. For example, the interior cable 306 may be routed around the axle 318 and between the guide disks 320 (see FIG. 4). The guide disks 320 may guide flexion of the interior cable 306 within the spool 204 to prevent the interior cable 306 from winding or flexing excessively in any given region along the length of the spool 204. For example, the guide disks 320 may keep the interior cable 306 from bunching when the retractable cable 208 is extended or retracted.

Figure 4:
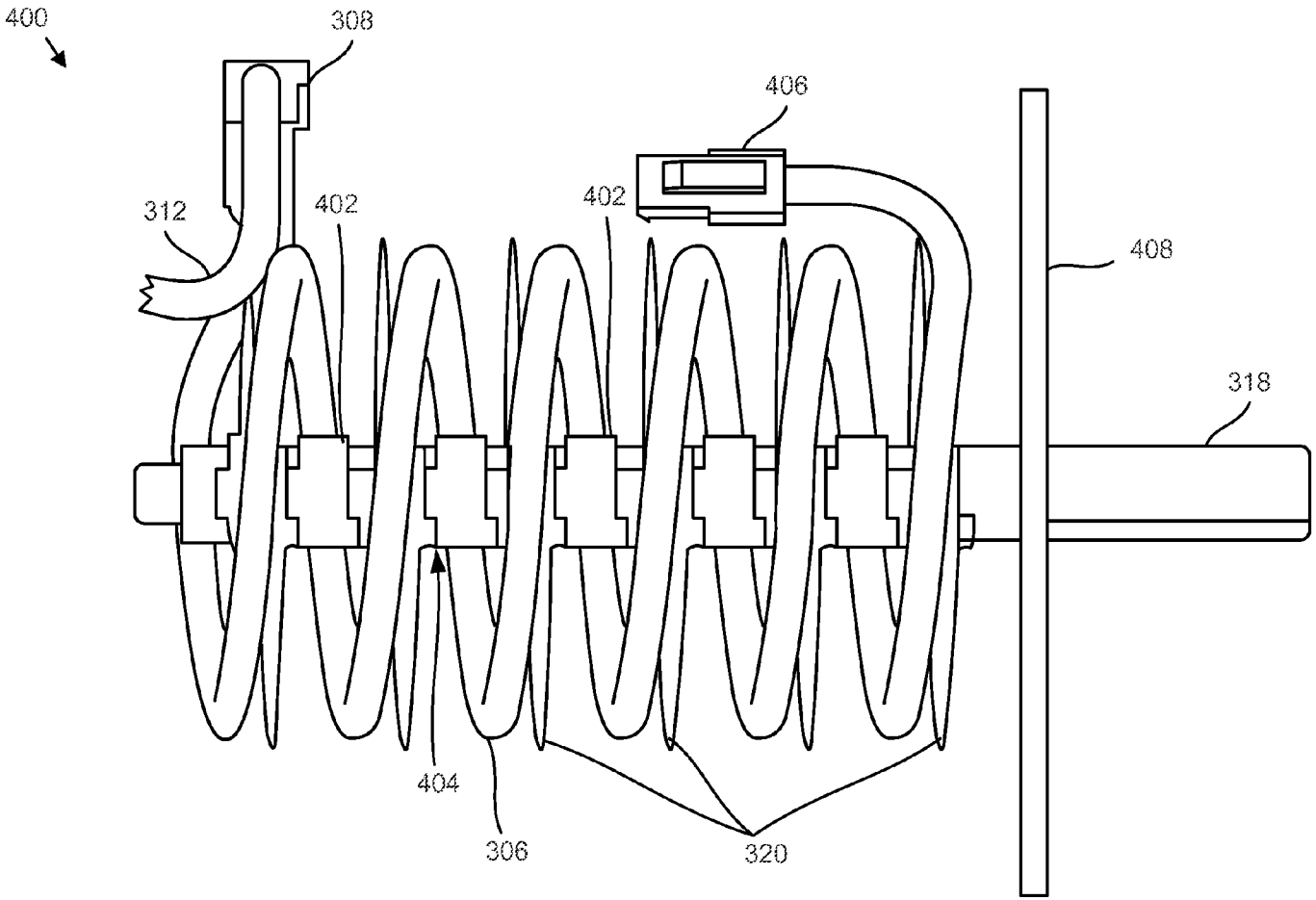
FIG. 4 is a perspective view of an interior cable assembly, according to one embodiment.

FIG. 4 illustrates an interior cable assembly 400 showing the winding or routing of the interior cable 306 around the axle 318 and through the guide disks 320, according to one embodiment. The retractable cable 208 and some other components are excluded to avoid obscuring the interior cable 306 and other components of the interior cable assembly 400. In the depicted embodiment, the interior cable assembly 400 includes six guide disks 320 and five alignment collars 402. The interior cable assembly 400 also includes a plate 408 which may be used to support and/or fasten a spool 204 in relation to the axle 318. The guide disks 320 have a disk shape forming part of a helix. For example, the guide disks 320 may not be flattened within a plane but may form a small section of a helix or screw. The interior cable 306 is wound between the guide disks 320, forming a helix. The alignment collars 402, or bushings, control spacing, relative rotation, and relative location of the guide disks 320. For example, the alignment collars 402 may keep a specific spacing between the guide disks 320 and may limit rotation of the guide disks 320 in relation to each other. In one embodiment, stepped interfacing surfaces of the guide disks 320 and the alignment collars 402 constrain their relative rotational placement (see, for example, at location 404). In one embodiment, the guide disks 320 are free to rotate within limits dictated by the stepped interfaces.

The interior cable 306 extends from the junction 308, through the guide disks 320, and around the axle 318 to an electrical connector 406. The electrical connector 406 is configured to connect to an end of the retractable cable 208. A corresponding connector may be on an end of the retractable cable 208. In one embodiment, the electrical connector 406 is coupled to the retractable cable 208 at a rotating location. For example, the electrical connector 406 may rotate with the spool 204 as the retractable cable 208 is extended and retracted. In one embodiment, electrical conductors or contacts of the electrical connector 406 are substantially stationary with respect to a corresponding connector of the retractable cable 208. For example, electrical conductors connecting the retractable cable 208 and the interior cable 306 may be substantially stationary with respect to each other during rotation of the spool 204. For example, the connector of the retractable cable 208 and the connector 406 of the interior cable 406 may be connected such that the electrical conductors are not allowed to slide or rotate with respect to each other. In one embodiment, the electrical connector 406 may be one part of a plug/jack connector to couple the retractable cable 208 and the interior cable 306. In one embodiment, conductors of the retractable cable 208 and the interior cable 306 may be welded or soldered together. In one embodiment, the interior cable 306 and the retractable cable 208 may be part of the same continuous electrical cable (e.g., having one or more continuous electrical conductors or wires).

In one embodiment, electrical conductors connecting the retractable cable 208 and the interior cable 306 (or other stationary conductor or location) may rotate and/or slide relative to each other. For example, a phono plug and jack connector, which is well-known in the art, may be used to provide electrical connection between the retractable cable 208 and the interior cable 306. For example, the phono plug and jack may be connected to power cables instead of audio cables. The phono plug and jack may include electrical connectors that are commonly used in audio equipment and audio interconnections which are allowed to rotate relative to each other. In one embodiment, the phono plug and jack are positioned along an axis of rotation of the spool 204. The phono plug and jack may rotate relative to each other and maintain electrical contact during rotation of the spool 204.

The interior cable 306 extends between a rotating location (e.g., the connector 406 rotates with the spool 204) and a stationary location (e.g., the junction 308 remains stationary). In one embodiment, the fixed location may include a port or connector to connect to a device and the rotating location may include a port or connector to connect to a retractable cable. Thus, the interior cable 306 accommodates movement of the spool 204 in relation to the bracket 202 by twisting, flexing, winding, and/or unwinding as the retractable cable 208 is extended or retracted. The interior cable 306 provides electrical communication between two locations that move relative to each other, without any sliding electrical contacts. Elimination of sliding electrical contacts can allow for greater longevity of the cable retractor 102 as well as reducing resistance between moving and stationary parts. In one embodiment, due to the length of the interior cable 306, the strains on the interior cable 306 are minimal and allow for long life. Similarly, the interior cable 306 may include particularly flexible material and/or wires to reduce strain or breakage of electrical conductors.

In one embodiment, the interior cable 306 is pre-bent, pre-twisted, or pre-flexed to accommodate at least a portion of the rotation of the spool 204. For example, the interior cable 306 may include a pre-bent or pre-twisted shape to reduce any strain experienced by the interior cable 306. In one embodiment, the interior cable 306 is pre-bent so that the interior cable 306 experiences a neutral strain when the retractable cable 208 is halfway extended from or retracted on the spool 204. This may reduce the total strain experienced by the interior cable 306 by one half. In one embodiment, the interior cable 306 may provide a biasing force to rotationally bias the spool 204 in a retracting direction. For example, a power spring 206 may not be needed because the biasing force may be provided by the interior cable 306, which also serves the purpose of electrically coupling a retractable cable 208 to a device attached to the cable retractor 102.

Figure 5:
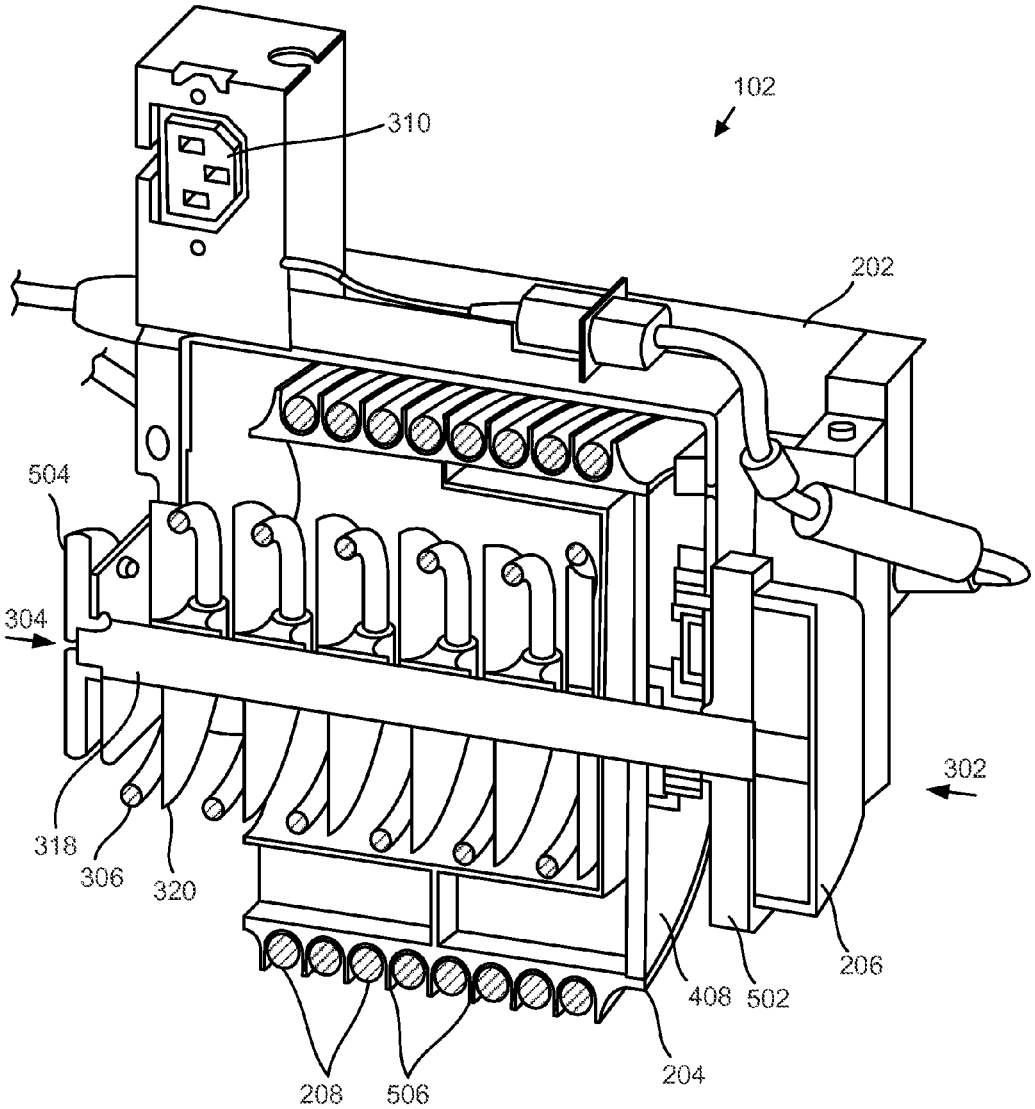
FIG. 5 is a cross-sectional side view of a cable retractor, according to one embodiment.

FIG. 5 illustrates a cross-sectional view of components of a cable retractor 102, according to one embodiment. FIG. 5 illustrates the plate 408 that mechanically supports and fastens the spool 204 to the axle 318 or shaft. The axle 318 is mechanically supported and fastened to the bracket 202 by a first bearing 502 and by a second bearing 504. The power spring 206 (or other spring) torsionally preloads the axle 318. The power spring 206 is housed in a housing and is fastened to the bracket 202 via a power spring housing, sandwiching the first bearing 502 onto the bracket 202. The power spring 206 also provides a restorative torsion on the axle 318 when the retractable cable 208 is deployed.

A cross-sectional shape of the spool 204 and grooves is also shown. The spool 204 includes ridges 506, or raised portions, which form grooves in which the retractable cable 208 is positioned when the retractable cable 208 is on the spool 204. In one embodiment, as the retractable cable 208 is selectively retracted the spool 204 rotates and the retractable cable 208 is guided into the helical groove between the ridges 506. In one embodiment, the ridges 506 form a helical groove having a width corresponding to a cross-sectional width of the retractable cable 208. In one embodiment, the ridges 506 (or a single ridge) form a helical groove that is continuously connected to and circumscribes the spool 204 a plurality of times. The ridges 506 and groove extend from a location proximal to first end 302 of the spool 204 to a location proximal to a second end 304 of the spool 204. In one embodiment, the ridges 506 have a height sufficient to receive a cross-sectional width of the retractable cable 208. Ridges 506 having a height equal to or greater than the cross-sectional width of the retractable cable 208 may more effectively guide the retractable cable 208 into the grooves than more shallow ridges.

Figure 6:
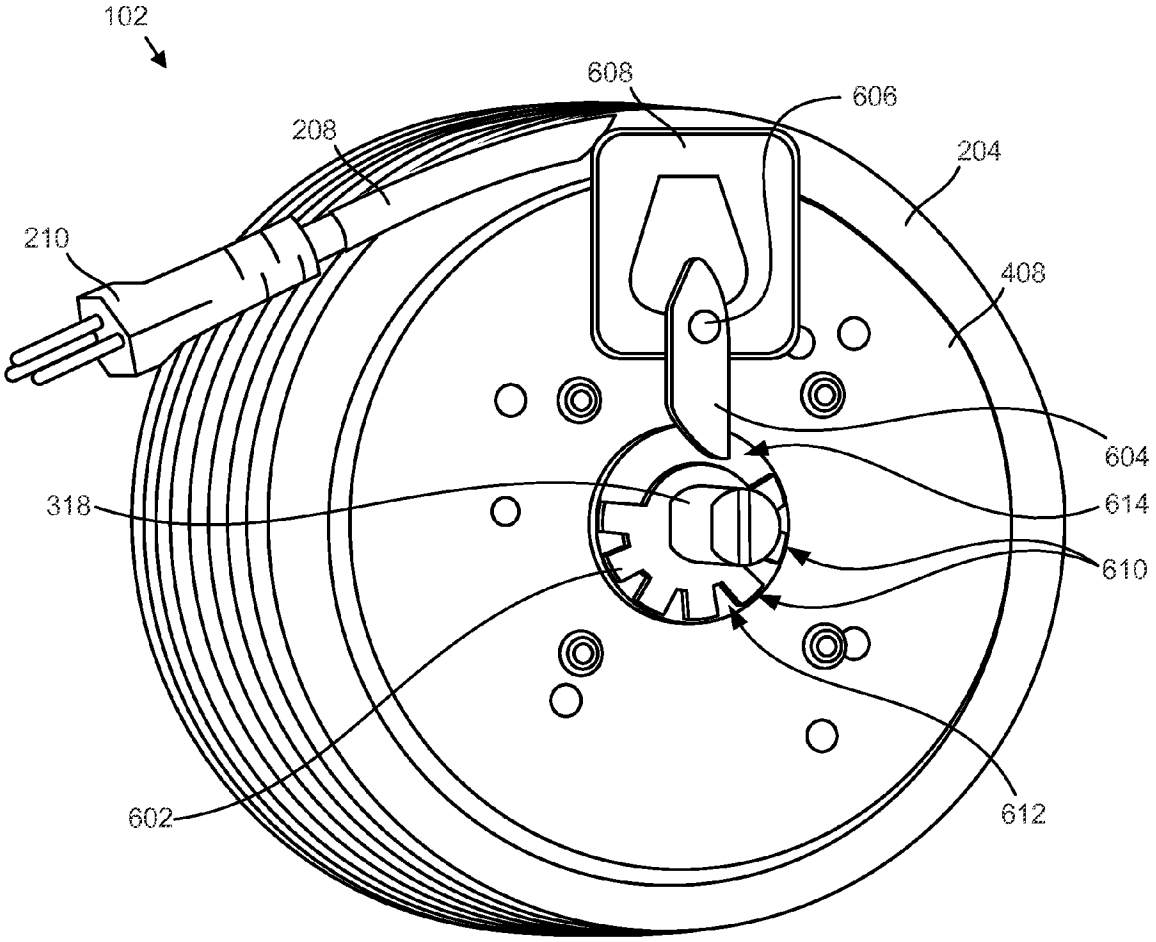
FIG. 6 is a perspective side view of a ratchet and pawl for a cable retractor, according to one embodiment.

FIG. 6 is a perspective side view of a cable retractor 102 illustrating a ratchet 602 and a pawl 604 for controlling retraction of the retractable cable 208. The ratchet 602 is mounted and rotationally bound to the axle 318 and the spool 204. The pawl 604 is stationary (e.g., mounted on the bracket 202) but is able to pivot at pivot point 606. A tension spring may bias the pawl 604 in default vertical alignment as shown in order to engage the ratchet 602. In one embodiment, the tension spring is enclosed in a spring housing 608.

The ratchet 602 includes a plurality of teeth 610. The teeth 620 are spaced to form a plurality of small gaps 612 and a large gap 614. When the spool 204 is at a rotational position such that the pawl 604 engages a small gap 612, the pawl 604 restricts movement of the spool 204 in a retracting direction but still allows a user to further extend the retractable cable 208 by pulling the retractable cable 208 in an extending direction. When the spool 204 is at a rotational position such that the pawl 604 is positioned in the large gap 614, the spool 204 may begin moving in a retracting direction and continue moving in that direction toward a retracted position. For example, as the axle 318 rotates, the ratchet 602 is intermittently prevented from retracting due to the point of the pawl 604 engaging with the teeth 610 of the ratchet 602. When the pawl 604 coincides with the region of ratchet 602 without teeth 610 (e.g., the large gap 614), the axle 318 and the spool 204 are free to rotate for retraction of the retractable cable 208 because the teeth 610 press against only a curved edge of the pawl 604, which provides no substantial resistance.

In one embodiment, the large gap 614 corresponds to a rotational position where the retractable cable 208 is fully extended. For example, when the retractable cable 208 is fully extended, the ratchet 602 and the pawl 604 allow a biasing member to retract the retractable cable 208. The large gap 614 may also correspond to a plurality of intermediate positions such that the retractable cable 208 must not be fully extended in order to initiate retraction. Thus, the pawl 604 intermittently allows retraction of the retractable cable 208. In one embodiment, the groove on the spool 204 causes a specific rotational position of the spool 204 to accurately correspond to a specific length of the retractable cable 208 that is on or off the spool 204. In some embodiments, this ensures that the pawl 604 will be positioned in the large gap 614 when the retractable cable 208 is fully extended, which keeps the retractable cable 208 from getting stuck in an extended position.

Example operation of the cable retractor 102, according to one embodiment, will now be explained. The cable retractor 102 may be operated by a user by pulling the plug connector 210 and thereby causing the spool 204 to spin and for the retractable cable 208 to be unwound from the spool 204. The dispensing guide 212 ensures that the retractable cable 208 exits from the spool 204 at a known angular position. Similarly, the helical grooves on the spool 204 ensure that the spool 204 rotates a precise number of turns (e.g., eight turns of 360° in the embodiments of FIGS. 2-6) from the beginning to the end of the deployment. As such, when the retractable cable 208 is fully deployed, the pawl 604 is positioned over the region of the ratchet 602 without teeth 610, and therefore does not prevent the retractable cable 208 from being retracted by the force applied by the power spring 206.

During deployment and retraction of the retractable cable 208, the fastened end of the interior cable 306 rotates relative to a stationary end (e.g., up to eight turns in each direction). The guide disks 320, in conjunction with the alignment collars 402, constrain the interior cable 306 as this rotation occurs, and thereby maintain orderly constriction and expansion of the interior cable 306. In particular, the guide disks 320 prevent the interior cable 306 from winding or unwinding excessively in any given region along the length of the axle 318 (i.e., shaft) or spool 204.

It should be noted that in one embodiment, the interior cable 206 is pre-coiled through appropriate fabrication processes, as this may ease assembly somewhat. However, pre-coiling may not be essential to the proper function of the cable retractor 102. It should also be noted that the system of guide disks 320 and alignment collars 402 may be indefinitely extended over any distance to permit more rotations of the spool 204 if this is desired to achieve a longer deployed retractable cable 208 length. Some limitation on the length of an axle 318 and/or the number of guide disks 320 or alignment collars 402 include potential degraded function due to increased friction, and greater space required. The number of guide disks 320 and alignment collars 402 may vary as needed over the length of the spool 204. For example, fewer or more guide disks 320 may be included over the same length, in some embodiments.

By way of further detail, when the spool 204 rotates during deployment of the retractable cable 208, the spool 204 may initially rotate freely with respect to the guide disks 320, but after a predetermined amount of rotation a tooth or feature on the spool 204 may engage a tooth or protrusion on the adjacent guide disk 320 and subsequently causes it to rotate. After another predetermined amount of rotation, a far tooth on the guide disk 302 may engage a near tooth on an adjacent alignment collar 402, causing it to rotate. After yet another predetermined amount of rotation, a far tooth on the adjacent alignment collar 402 engages a near tooth on the next guide disk 320, and so on, all the way to the last guide disk 320. When the spool 204 rotates during retraction of the retractable cable 208, a similar sequence of events occurs, with the teeth or protrusions of the guide disks 320 and the alignment collars 402 engaging in series, causing an inverted sequence of rotations and interferences to occur.

In addition to the embodiments discussed above, several other embodiments are also contemplated within the scope of the present disclosure. According to one embodiment, the interior cable 306 is not pre-coiled. According to one embodiment, one or more cable supports may be provided in or on the interior cable 306. For example, the cable supports may create a default position for the interior cable 306 to which the interior cable 306 returns after being flexed or twisted. Similarly, the cable supports may keep any portion of the interior cable 306 from being excessively twisted or bent during flexion of the interior cable 306. For example, the cable supports may eliminate a need for guide disks 320 and/or alignment collars 402. In one embodiment, the cable supports may serve to bias the interior cable 306, and the spool 204, toward a retracted position.

Figure 7:
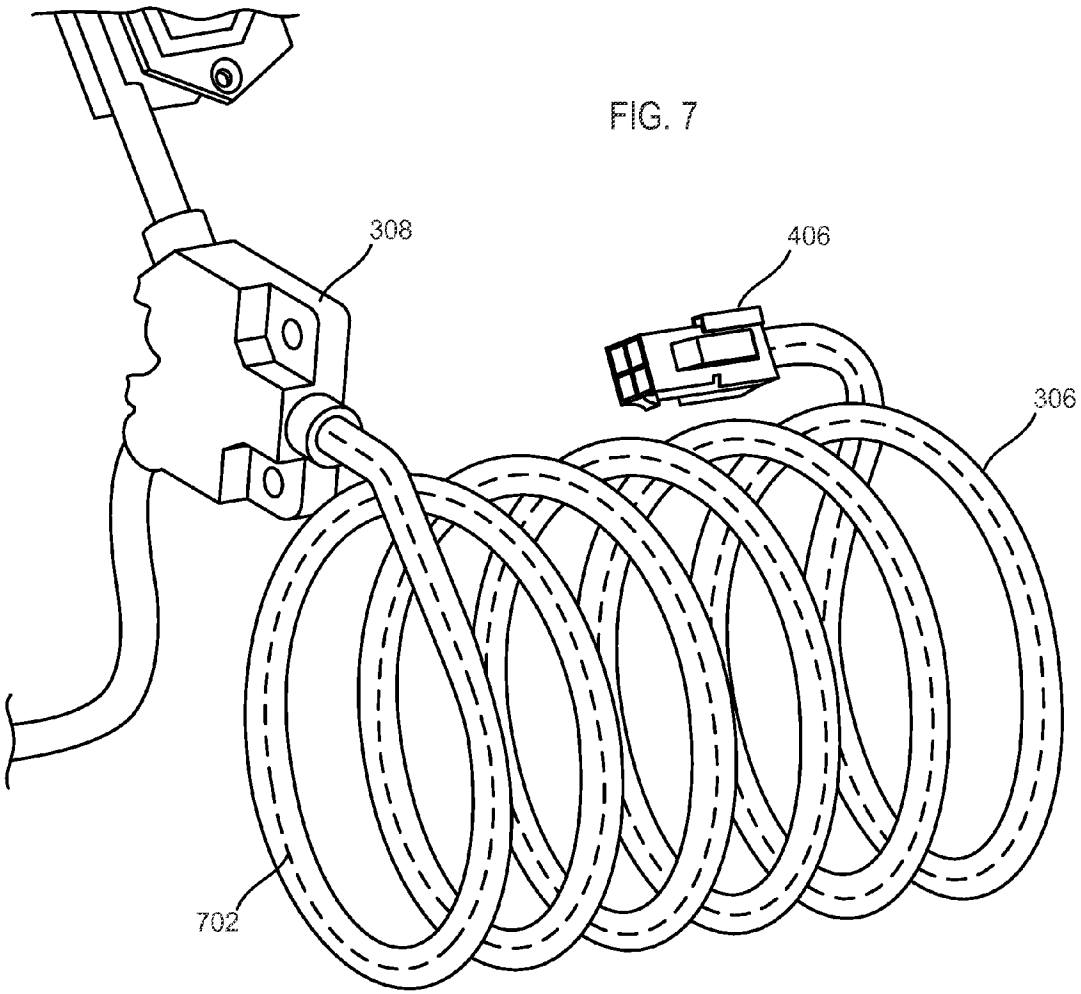
FIG. 7 is a perspective view of an interior cable with a cable support, according to one embodiment.

FIG. 7 is a perspective view of an interior cable 306 with an embedded cable support 702. The embedded cable support 702 is represented by a broken line and runs through the interior of the interior cable 306. For example, the embedded cable support 702 may include an appropriate metal wire down a center of the interior cable 306. The embedded cable support 702 may cause the interior cable 306 to constrict and expand in a deterministic manner, for example, like a helical spring.

In one embodiment, the embedded cable support 702 may cause the interior cable 306 to have a pre-bent or pre-twisted shape. In one embodiment, the pre-bent or pre-twisted shape corresponds to a number of bends or twists in the interior cable 306 when the retractable cable 208 is extended about halfway between a fully retracted state and a fully extended state. In one embodiment, the embedded cable support 702 (or other flexible support structures) may control flexion of the interior cable 306 during rotation of the spool 204.

In one embodiment, a cable support may be used, similar to the embedded cable support 702 described above, except the cable support may be attached to an exterior of the interior cable 306. For example, a metal wire may be attached on an exterior[GJ2] of the interior cable 306 using shrink tubing or the like such that the interior[GJ3] cable 306 constricts and expands in a deterministic manner, like a helical spring, without the need for the guide disks 320 and the alignment collars 402. In one embodiment, a cable jacket of the interior cable 306 may include non-standard materials that increase rigidity, while still being flexible, to cause the interior cable 306 to constrict and expand in a deterministic manner. In one embodiment, the interior cable 306 has a modified or reinforced cable jacket to provide more rigidity, and/or may include a greater length such that there are more coils. In one embodiment, the interior cable 306 constricts in a slightly chaotic manner, due to uncontrolled interference of the interior cable 306 along the axis of the axle 318, yet without the need of the guide disks 320 and the alignment collars 402 to reliably achieve the required number of rotations, and to reliably return to a known default shape.

Figure 8:
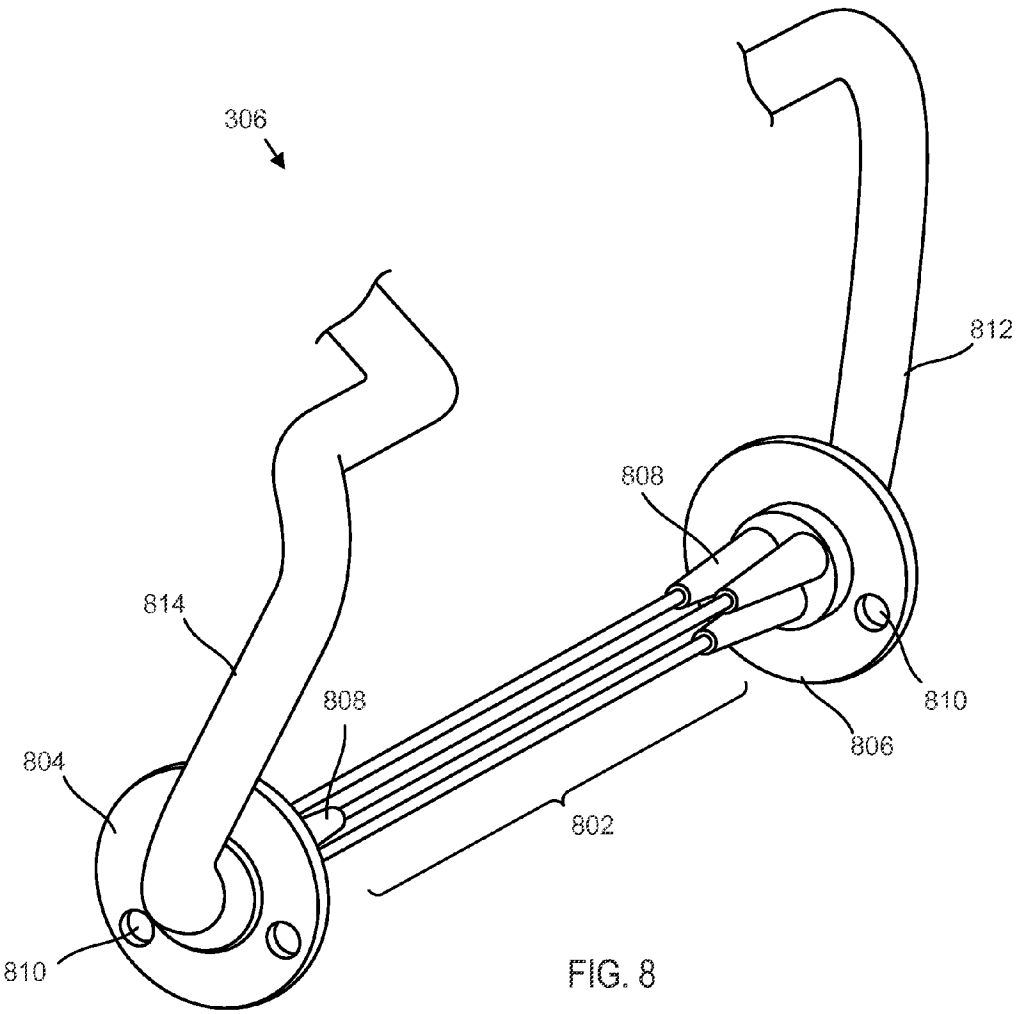
FIG. 8 is a perspective view of an interior cable that includes one or more separate wire sections, according to one embodiment.

FIG. 8 illustrates one embodiment of an interior cable 306 that includes one or more separate wire sections 802. In one embodiment, the separate wire sections 802 are positioned on a rotational axis of the spool 204. For example, the axle 318 may be omitted so that the separate wire sections 802 may be positioned on the rotational axis. The separate wire sections 802 extend between a first anchor 804 positioned near one end of the spool 204 and a second anchor 806 positioned near an opposite end of the spool 204. The anchors 804, 806 may include holes 810 or other features to mount the anchors 804, 806 to a fixed or rotating location. In one embodiment, the first anchor 804 remains stationary and the second anchor 806 rotates with spool 204. For example, when the spool 204 rotates, the separate wire sections 802 of the interior cable 306 twist about each other in a helical manner (or untwist).

In the depicted embodiment, the separate wire sections 802 include wires without a common cable jacket. For example, wire conductors of the interior cable 306 may be within a cable jacket at a first end 812 and a second end 814 of the interior cable 306 but may be separate wires (with insulating shielding) between the anchors 804, 806. It should be understood that the separate wire sections 802 may only be straight (or approximately straight) at one point of the rotation of the spool 204. In one embodiment, the separate wire sections 802 may be a little longer than needed to reduce strain during rotation of the spool 204. In one embodiment, the separate wire sections 802 are approximately straight when the retractable cable 208 is halfway extended. For example, a default state of the separate wire sections 802 may be such that an anchor 804 is rotated half the number of total spool 204 rotations required to fully extend a retractable cable 208. This may cause the separate wire sections 802 to unwind as a retractable cable 208 is pulled from a fully retracted state to a halfway extended state and to wind around each other as the retractable cable 208 is pulled from the halfway extended state to a fully extended state. The winding/unwinding may happen in reverse as the retractable cable 208 is retracted. This pre-wound state may reduce the maximum torsional stress more than[GJ4] if the separate wire sections 802 are required to wind (or unwind) between a fully retracted and a fully extended rotational position of the spool 204. In one embodiment, the separate wire sections 802 have strain reliefs 808 where they are fastened to the anchors 804, 806 to reduce bending stresses near the anchors 804, 806 and increase the life of the separate wire sections 802. The strain reliefs 808 may reduce a degree of flexion of the one or more second lengths of electrical cables proximal to one or more of the first location and the second location.[GJ5]

In one embodiment, the first anchor 804 and second anchor 806 may be mounted such that they can slide along the axis, so that they can move toward each other to reduce stress as the wires are twisted and/or move outward as the wires are untwisted. Furthermore, one or more springs may be used to preload or bias the anchors 804, 806 away from each other. In one embodiment, a compression spring may extend between the anchors 804, 806 to provide a force to push the anchors 804, 806 away from each other to restore them to their original positions as the wires are untwisted. In one embodiment, separate compression springs or tension springs may be used to independently push or pull the anchors 804, 806 away from each other. For example, a first tension spring may extend between the first anchor 804 and stationary location (or location that doesn't slide along an axis of rotation) to pull the first anchor away from the second anchor 806. Similarly, an additional tension or compression spring may be used to bias the second anchor 806 away from the first anchor 804.

In the embodiments discussed above, the interior cable 306 occupies a large portion of a length of the spool 204. For example, the greater the length of the interior cable 306, the lower the stress the interior cable 306 may experience as the spool 204 rotates. In one embodiment, the interior cable 306 may be wound in a more two-dimensional shape to limit a longitudinal space (space in a direction of an axis of the spool 204) occupied by the interior cable 306. For example, the interior cable 306 may be wound in an Archimedean spiral such that ends of the interior cable 306 are at an outer edge of the spiral and a halfway point of the interior cable 306 is located at the center of the Archimedean spiral.

Although the present disclosure focuses on cable retractors for power cables, it should be understood that cable or cord retractors for any type of cable or cord are contemplated. For example, cable retractors for retracting hoses that carry liquid or air may employ many of the teachings provided herein.

EXAMPLES

The following examples pertain to further embodiments.

Example 1 is a cord retractor mechanism that includes a support member (e.g., a bracket 202), a first length of electrical cord, a spool, and a second length of electrical cord. The spool includes a helical groove on an outer surface of the spool. The helical groove has a width corresponding to a cross-sectional width of the first length of electrical cord and the spool is rotatably mounted on the support member. The second length of electrical cord is electrically coupled to the first length of electrical cord. A first portion of the second length of electrical cord is secured at a rotating location and a second portion of the second length of electrical cord is secured at a stationary location, wherein the rotating location moves with the spool and the stationary location remains stationary with respect to the support member. The first length of electrical cord is selectively extendable from and retractable on the spool and the second length of electrical cord flexes to accommodate the movement of the rotating location with respect to the stationary location while maintaining electrical communication between the rotating location and the stationary location. When the first length of electrical cord is selectively retracted the spool rotates and the first length of electrical cord is guided into the helical groove on the spool.

Example 2 is a cord retractor mechanism that includes an electrical cord, a rotatably mounted spool, a grommet, a bias mechanism, a ratchet, and a pawl. The rotatably mounted spool includes a helical groove on an outer surface of the spool. The helical groove is a continuously connected groove circumscribing the spool a plurality of times and extending from a location proximal to a first end of the spool to a location proximal to a second end of the spool. The helical groove has a width corresponding to a cross-sectional width of the electrical cord. The grommet guides the electrical cord to extend from the spool at a known or specific angular location. The bias mechanism biases the spool in a retracting rotational direction. The ratchet is mounted to rotate with the rotatably mounted spool and includes a plurality of teeth. A gap between the teeth at a rotational position corresponding to the electrical cord being fully extended from the spool has a larger size than gaps corresponding to other rotational positions. The pawl is configured to engage the teeth of the ratchet to intermittently prevent rotation of the spool in the retracting rotational direction.

Example 3 is a device that includes a rotatably mounted spool, a first length of electrical cable, and one or more second lengths of electrical cables. The first length of electrical cable is flexible to selectively wind around or unwind from the spool. The one or more second lengths of electrical cables extend between a first port to connect with the first length of electrical cable and a second port to connect with an electrical device at a second location. The one or more second lengths of electrical cables extend between a first location and a second location. The first location is a location that rotates with the spool, and the second location is stationary such that the first location rotates relative to the second location. When the spool rotates, the one or more second lengths of electrical cables flex to accommodate the movement of the first location with respect to the second location while maintaining electrical communication between the first location and the second location.

Reference throughout this specification to an "example" or an "embodiment" means that a particular feature, structure, or characteristic described in connection with the example is included in at least one embodiment of the present invention. Thus, appearances of the phrase "for example" or "in one embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another, but are to be considered as separate and autonomous representations of the present invention.

It will be obvious to those having skill in the art that many changes may be made to the details of the above-described embodiments without departing from the underlying principles of the invention. The scope of the present invention should, therefore, be determined only by the following claims.

The invention claimed is:

1. A cord retractor comprising:

a support member;

a first length of electrical cord;

a spool comprising a helical groove on an outer surface of the spool, wherein the helical groove comprises a width corresponding to a cross-sectional width of the first length of electrical cord, wherein the spool is rotatably mounted on the support member; and a second length of electrical cord electrically coupled to the first length of electrical cord and helically extending within, radially separated from, and co-axially relative to the spool, wherein a first portion of the second length of electrical cord is secured at a rotating location and a second portion of the second length of electrical cord is secured at a stationary location, wherein the rotating location moves with the spool and the stationary location remains stationary with respect to the support member;

wherein the first length of electrical cord is selectively extendable from and retractable on the spool and wherein the second length of electrical cord flexes to accommodate the movement of the rotating location with respect to the stationary location while maintaining electrical communication between the rotating location and the stationary location, and wherein when the first length of electrical cord is selectively retracted the spool rotates and the first length of electrical cord is guided into the helical groove.

2. The cord retractor of claim 1, wherein the helical groove comprises a continuously connected groove circumscribing the spool a plurality of times and extending from a location proximal to first end of the spool to a location proximal to a second end of the spool.

3. The cord retractor of claim 2, further comprising a dispensing guide comprising an opening to cause the first length of electrical cord to extend from the spool at a predetermined angle in relation to the spool, wherein an amount of the first length of electrical cord wound on the spool in the helical groove is determined based on the rotational position of the spool.

4. The cord retractor of claim 1, wherein the support member comprises an attachment mechanism to secure the cord retractor to an electrical device.

5. The cord retractor of claim 1, further comprising one or more bearings supporting the spool in relation to the support member.

6. The cord retractor of claim 1, wherein the second length of electrical cord comprises a pre-bent or pre-twisted shape to accommodate flexion during rotation of the spool.

7. The cord retractor of claim 6, wherein the pre-bent or pre-twisted shape comprises a pre-bent or pre-twisted shape corresponding to a number of bends or twists in the first length of electrical cord when the first length of electrical cord is extended about halfway between a fully retracted state and a fully extended state.

8. The cord retractor of claim 6, wherein the second length of electrical cord comprises one or more flexible support structures to control flexion of the second length of electrical cord during rotation of the spool.

9. The cord retractor of claim 1, further comprising a biasing member configured to rotationally bias the spool in a retracting direction.

10. The cord retractor of claim 1, wherein the second length of electrical cord provides a biasing force to rotationally bias the spool in a retracting direction.

11. The cord retractor of claim 1, further comprising a ratchet rotating with the rotatably mounted spool and comprising a plurality of teeth, wherein a gap between the teeth at a rotational position corresponding to the first length of electrical cord being fully extended from the spool comprises a larger size than gaps corresponding to other rotational positions.

12. The cord retractor of claim 11, further comprising a pawl rotatably fixed to the support member and configured to engage the teeth to selectively limit rotation of the spool in a retracting direction, wherein when the pawl is positioned in the gap between the teeth at the rotational position corresponding to the first length of electrical cord being fully extended, the pawl allows the ratchet and spool to rotate in the retracting direction.

13. A cord retractor comprising:

an electrical cord;

a rotatably mounted spool comprising a helical groove on an outer surface of the spool, the helical groove comprising a continuously connected groove circumscribing the spool a plurality of times and extending from a location proximal to a first end of the spool to a location proximal to a second end of the spool, and wherein the helical groove comprises a width corresponding to a cross-sectional width of the electrical cord;

a grommet configured to guide the electrical cord to extend from the spool at a known angular location;

a bias mechanism to bias the spool in a retracting rotational direction;

a ratchet rotating with the rotatably mounted spool comprising a plurality of teeth, wherein a gap between the teeth at a rotational position corresponding to the electrical cord being fully extended from the spool comprises a larger size than gaps corresponding to other rotational positions; and a pawl configured to engage the teeth of the ratchet to intermittently prevent rotation of the spool in the retracting rotational direction.

14. The cord retractor of claim 13, wherein the electrical cord comprises a plug connector at an end extending from the spool, wherein the plug connector is configured to couple to an electrical outlet.

15. The cord retractor of claim 14, further comprising an outlet port configured to electrically connect the cord retractor to an electrical device, wherein the electrical cord is configured to provide electrical energy from an outlet to the outlet port.

16. The cord retractor of claim 13, further comprising a plug and jack to provide electrical connection between the electrical cord and a stationary location, wherein the plug and jack are positioned along an axis of rotation of the spool and wherein the plug and jack rotate relative to each other and maintain electrical contact during rotation of the spool.

17. A device comprising:

a rotatably mounted spool;

a first length of electrical cable, wherein the first length of electrical cable is flexible to selectively wind around or unwind from the spool; and one or more second lengths of electrical cables helically extending within, radially separated from, and co-axially relative to the spool and between the first length of electrical cable and a port to connect with an electrical device wherein the one or more second lengths of electrical cables extend between a first location and a second location, wherein the first location comprises a location that rotates with the spool and the second location is stationary such that the first location rotates relative to the second location and wherein when the spool rotates the one or more lengths of second lengths of electrical cables flex to accommodate the movement of the first location with respect to the second location while maintaining electrical communication between the first location and the second location.

18. The device of claim 17, wherein, at at least one rotational position of the spool, the one or more second lengths of electrical cables are bent or twisted in a shape comprising one or more of:

an Archimedean spiral;

a helix; and a substantially straight section.

19. The device of claim 17, further comprising one or more strain reliefs configured to reduce a degree of flexion of the one or more second lengths of electrical cables proximal to one or more of the first location and the second location.

20. The device of claim 17, further comprising an axle, wherein the spool is mounted on the axle.

21. The device of claim 20, further comprising one or more guide disks mounted on the axle and within the spool, wherein the one or more second lengths of electrical cables are routed around the axle and between the guide disks, and wherein the guide disks guide flexion of the one or more second lengths of electrical cables within the spool to prevent the one or more second lengths of electrical cables from winding or unwinding excessively in any given region along the length of the spool.

22. The device of claim 21, further comprising one or more alignment collars configured to constrain relative location and placement of the one or more guide disks.

23. The device of claim 17, wherein electrical contacts connecting the first length of electrical cable and the one or more second lengths of electrical cables are substantially stationary with respect to each other during rotation of the spool.

24. The device of claim 23, wherein the first length of electrical cable and the one or more second lengths of electrical cables are connected such that the electrical contacts are not allowed to slide or rotate with respect to each other.

25. The device of claim 23, further comprising a plug and jack comprising the electrical contacts.

26. The device of claim 17, wherein the first length of electrical cable and the one or more second lengths of electrical cables are one of:

part of a single continuous electrical cable; and are electrically connected via electrical contacts soldered or welded together at the first location.

* * * * *